US006031505A

United States Patent [19]

Qi et al.

[11] Patent Number: 6,031,505

[45] Date of Patent: Feb. 29, 2000

[54] DUAL EMBEDDED ANTENNA FOR AN RF DATA COMMUNICATIONS DEVICE

[75] Inventors: Yihong Qi, Waterloo; Perry Jarmuszewski, Guelph; Lizhong Zhu, Waterloo; Peter J. Edmonson, Hamilton; Krystyna Bandurska, Waterloo; Robert A. Grant, Guelph, all of Canada

[73] Assignee: Research In Motion Limited, Waterloo, Canada

[21] Appl. No.: 09/105,354

[22] Filed: Jun. 26, 1998

[51] Int. Cl.[7] ..... H01Q 9/28

[52] U.S. Cl. ..... 343/795; 343/725; 343/729

[58] Field of Search ..... 343/795, 702, 343/700 MS, 725–730; H01Q 9/28

[56] References Cited

U.S. PATENT DOCUMENTS 5,841,403 11/1998 West ..... 343/702

5,903,240 5/1999 Kawahata et al. ..... 343/702

*Primary Examiner*—Don Wong
*Assistant Examiner*—Hoang Nguyen
*Attorney, Agent, or Firm*—Jones, Day, Reavis & Pogue; Charles B. Meyer, Esq.

[57] ABSTRACT

An RF antenna system is disclosed having at least one meandering antenna line with an aggregate structure formed to substantially extend in two dimensions, to effectively form a top-loaded monopole antenna. The meandering antenna line includes at least one localized bend for providing a compressed effective antenna length in a compact package. The present antenna can be made as an antenna system having discrete transmit and receive antenna lines, so as to form a dual antenna system. The localized bends on each line electromagnetically couple with the respective bends on the other line, thus increasing electromagnetic coupling efficiency, thereby increasing antenna bandwidth and gain.

9 Claims, 1 Drawing Sheet

DUAL EMBEDDED ANTENNA FOR AN RF DATA COMMUNICATIONS DEVICE

BACKGROUND OF THE INVENTION

The present invention is directed to the field of antennas used for RF data communications devices, particularly those used to transmit and receive digital signals, e.g., two-way pagers and the like. The antennas used with previous RF data communications devices are prone to significant problems. Many previous pagers are "one-way" pagers that are only able to receive a pager signal. However, many factors can contribute to the loss of an incoming message signal. Thus, it is desirable to employ a "two-way" pager that sends an acknowledgment signal to the remote station to confirm receipt of a message or to originate a message.

In previous VHF one-way pagers, it had been common to use a loop-type antenna, which is effective at receiving signals in the presence of the human body, which has properties that tend to enhance VHF radio signals. However, loop-type antennas are poor at the UHF frequencies needed for two-way pagers. Also, such antennas are typically embedded in a dielectric plastic pager body, which reduces the effective bandwidth of the received signal. Such a configuration has a very narrow bandwidth of typically about 1%. Such antennas also have poor gain performance when transmitting a signal, and are thus not useful for a two-way pager design.

Many previous two-way telecommunications devices use a "patch" antenna, in which a large, flat conducting member is used for sending and receiving signals. Patch antennas permit two-way communication under certain narrow bandwidth conditions, but do not provide a desirable radiation pattern. Signals propagate perpendicular to the flat surfaces of the antenna, and so the acknowledgment signal diverges within a bi-lobed conical envelope along an axis of propagation. While the signal transmits well "in front" and "behind" the pager, performance is poor if the signal axis is not well aligned with the remote station. Also, patch antennas are large, and can be as large as 16×16 $cm^2$. While this may be fine for a mobile laptop computer, such is not well suited for a small hand-held mobile unit such as a pager. Patch antennas can be made smaller, but at a significant sacrifice of gain.

An improved two-way pager antenna design is shown in U.S. Ser. No. 08/715,347, filed Sep. 18, 1996, entitled "Antenna System For An RF Data Communications Device." This design incorporates a dipole antenna capable of sending and receiving signals having both vertical and horizontal polarization components, thereby increasing the likelihood of acquiring the signal. The dipole antenna is incorporated into the pager lid and anisotropically coupled to the LCD pager display element. This coupling effect divides the central frequency into two separate peaks, thereby increasing pager bandwidth.

While excellent under ideal conditions, the coupling effect varies as a function of the spatial distance separating the LCD, variations in the anisotropic composition of the LCD, and ground planes of the pager circuit boards. As the lid is opened and closed, antenna gain can vary between 0 to 1 dB and −1 to 0 dB. Also, as this distance varies, the center frequency changes, affecting the antenna's very wide bandwidth. These effects tend to degrade antenna performance in either send or receive modes.

The above-noted design incorporates a RF switch to change the antenna between transmit and receive modes. This switch is expensive and very fragile to electrostatic discharge, adding expense to the manufacture and maintenance of the unit. Also, this switch is lossy, reducing antenna gain by about 0.5 dB. Further, with this design, LCD placement with respect to the antenna is critical, requiring fine tuning and tight manufacturing tolerances, resulting in labor-intensive (and thus expensive) manufacturing. Also, with the previous antenna design, impedance matching with the radio circuit is difficult. Testing the previous antenna is difficult since it could only be tested in an assembled pager, and so antenna failures contribute to unit failures during testing. Also, the antenna tends to interfere with the radio components in the pager, thereby further reducing performance.

BRIEF DESCRIPTION OF THE INVENTION

In view of the drawbacks and disadvantages associated with previous systems, there is a need for an RF communications antenna system that enables reliable two-way communication.

There is also a need for a two-way RF communications antenna system that provides a uniform radiation pattern within 360 degrees of azimuth.

There is also a need for an RF antenna system that is insensitive to variations in environmental conditions.

There is also a need for an RF antenna system that is simple in construction and can be manufactured with relaxed tolerances.

There is also a need for an RF antenna system that can be easily tested.

These needs and others are satisfied by the present invention in which a RF antenna system is provided having at least one meandering antenna line with an aggregate structure formed to substantially extend in two dimensions, to effectively form a half-wave, top-loaded monopole antenna. The meandering antenna line includes at least one localized bend for providing a compressed effective physical antenna length in a compact package. The present antenna can be made as an antenna system having discrete transmit and receive antenna lines, so as to form a dual antenna system. The localized bends on each line couple with the respective bends on the other line, thus increasing electromagnetic coupling efficiency, thereby increasing overall antenna bandwidth and efficiency.

As will be appreciated, the invention is capable of other and different embodiments, and its several details are capable of modifications in various respects, all without departing from the invention Accordingly, the drawings and description are to be regarded as illustrative in nature and not restrictive.

DETAILED DESCRIPTION OF THE INVENTION

Figure 1:
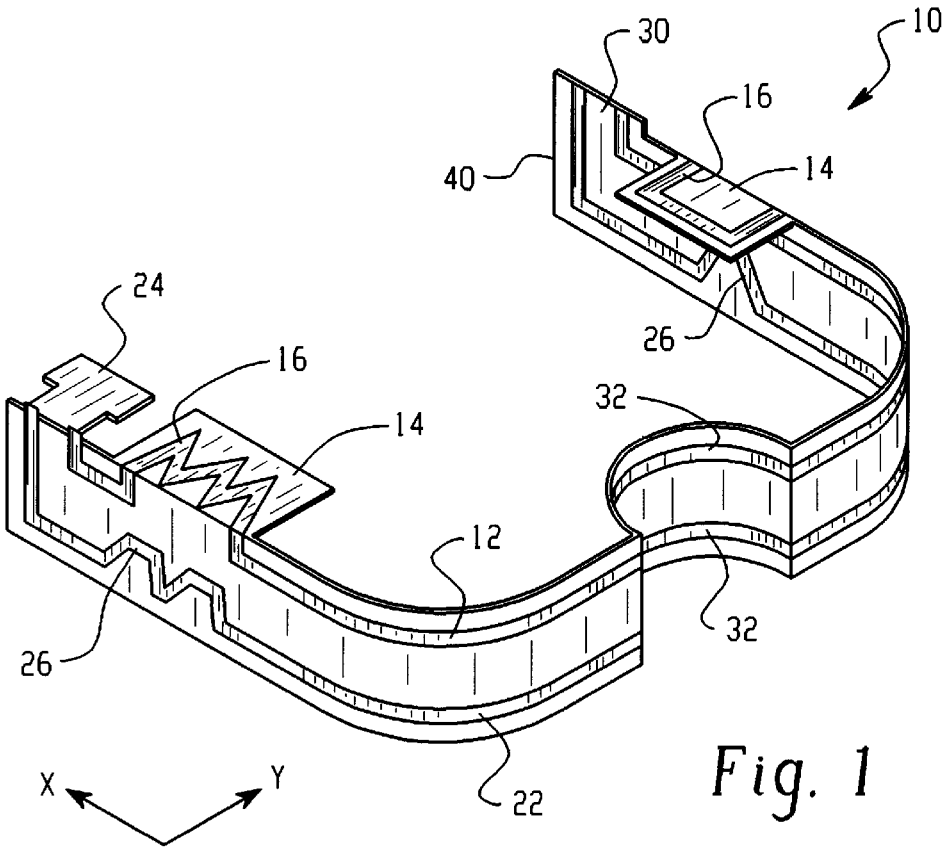
FIG. 1 shows a dual antenna system as according to the present invention.

As depicted in FIG. 1, the present invention incorporates an antenna system including at least one antenna element 12 with a meandering line structure. The aggregate structure of this antenna element 12 is formed so that it substantially extends in two dimensions, effectively forming a half-wave, top-loaded monopole antenna from a single antenna line capable of transceiving vertical and horizontal polarization components of a signal. As a further benefit, this meandering aggregate structure permits the antenna to have a comparatively long effective length compressed to a smaller size, e.g., within a pager housing.

As an additional feature, the present meandering antenna line 12 can include one or more extended portions 14, each having one or more localized bends 16. These localized bends 16 provide further compression of the antenna length. For example, a 16 cm antenna (corresponding to the half-wavelength of approximately a 900 MHz signal) can be preferably compressed in a 8.5×6 cm pager body in the manner illustrated in FIG. 1. In principle, even greater lengths can be compressed into smaller bodies by increasing the number of bends 16, providing greatly improved efficiency. The present design provides excellent radiation pattern characteristics, providing an omnidirectional "doughnut" radiation pattern that propagates in 360 degrees of azimuth.

The present antenna system 10 can include a single meandering antenna line 12, but in the preferred embodiment, the present antenna system 10 can include plural distinct meandering lines. In the preferred embodiment, as illustrated in FIG. 1, the present antenna system includes two meandering antenna lines 12, 22, where one of the lines 12, 22 is a transmit (Tx) antenna and the respective other line 12, 22 is a receiving (Rx) antenna. In the embodiment shown, the line 12 is preferably the Tx line and the line 22 is preferably the Rx line. The Tx line is preferably positioned to provide an advantageous transmission pattern with respect to the geometry of the internal pager components, so as to insure transmission to the remote station. This permits two separate narrowband channels to be used for Rx and Tx signals, rather than one wideband channel, as with the previous single antenna designs, By providing two center frequencies, the bandwidth extremities are reduced. Also, each antenna line 12, 22 can interface directly with the radio circuits, thereby eliminating the send/receive RF switch used with previous single antennas. In this way, the present antenna reduced complexity and cost by eliminating the expensive and fragile switch and the software required to actuate it. Further, antenna gain is increased, since the switch was lossy. The antenna lines 12, 22 are coupled to a connector 24, which includes a matching circuit, and can be formed on the circuit board. In these ways and others, radio performance is improved with the present antenna.

The present antenna is also less sensitive to the physical presence of the operator, since its design, determined by its geometry and matching circuit selection, will interact with the actual close pager environment first, and any other ambient interventions second. This therefore results in a 3 to 7 dB improvement in gain over previous VHF loop antennas, greatly improving the reception and transmission characteristics of the system.

Each meandering antenna line 12, 22 includes its own localized bends 16, 26. In the preferred embodiment, the bends 16, 26 are placed substantially adjacent. Applicants have observed that, in addition to providing greater effective antenna length, the adjacent bends 16, 26 also produce an electromagnetic coupling effect similar to that discussed in the aforementioned U.S. Ser. No. 08/715,347, the disclosure of which is hereby incorporated by reference. The localized bends 16, 26 provide greater concentrated current per unit length, which affects the coupling coefficient, permitting more effective coupling with the adjacent line. The coupling is described in Table 1 as follows:

TABLE 1

| Frequency | Coupling |
|---|---|
| 896 MHz | 6 dB |
| 897 MHz | 6 dB |
| 898 MHz | 6 dB |
| 899 MHz | 6 dB |
| 900 MHz | 6 dB |
| 901 MHz | 6 dB |
| 902 MHz | 5 dB |

Each antenna line 12, 22 has an associated eigenvector, and without coupling, these eigenvectors overlap along a common bandwidth. The coupling effect between the adjacent bends 16, 26 causes a separation of eigenvectors, in which the eigenvectors split asymmetrically about a central frequency, resulting in an increased effective bandwidth for the dual antenna system. Through the coupling effect, each meandering antenna line 12, 22 has the effective bandwidth of the coupled system. This coupling is accomplished without the LCD anisotropic media used in the U.S. Ser. No. 08/715,347, and so the present invention provides excellent results without being sensitive to the proximity problems of the previous device.

Figure 2:
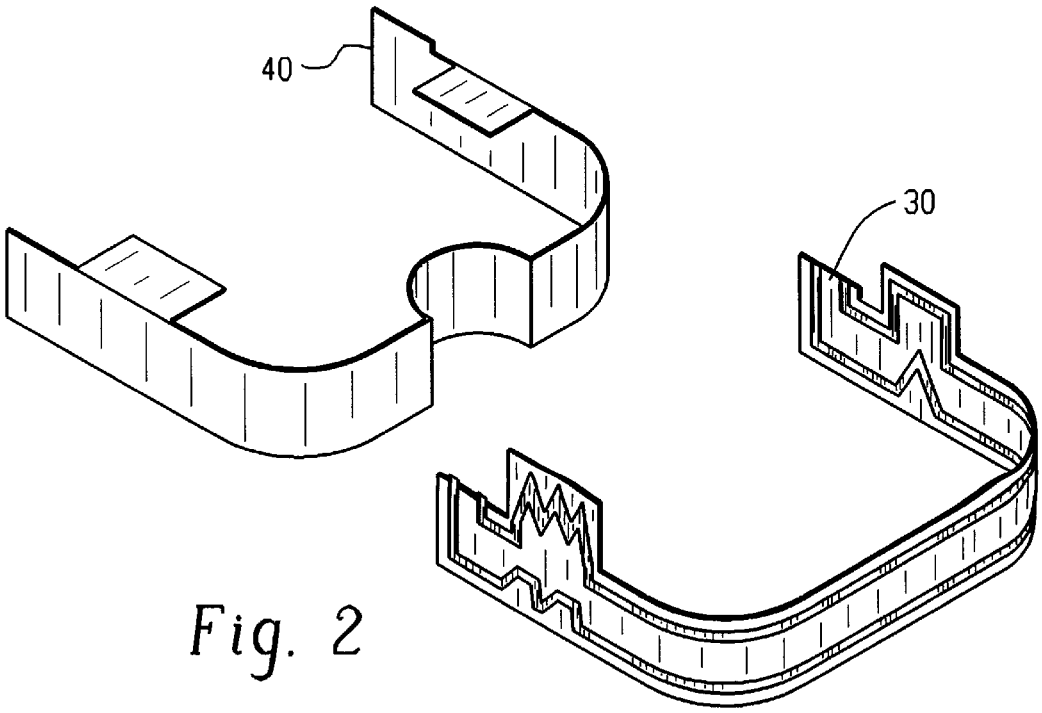
FIG. 2 is an exploded view depicting the dual antenna system of the present invention.

As best seen in FIG. 2, the meandering lines 12, 22 of the present dual antenna system are formed on a flexible substrate, e.g., a plastic dielectric retainer. The retainer 40 is formed of a plastic dielectric material which can be easily shaped to create the desired configuration. Also, the meandering lines 12, 22 can easily be formed directly on the flexboard 30 by etching a desired pattern directly onto a copper layer on the flexible circuit board material. In this way, any desired line pattern can be created simply and economically, permitting precise control of current densities along the antenna assembly.

Additionally, the retainer 40 assists in coupling between the lines due to the dielectric properties of the plastic material. The retainer 40 also creates a partial barrier between the antenna system and the pager circuit board, as the dielectric material is somewhat dispersive of the electromagnetic wave, moving the energy out of the bandwidth of the radio, and reducing interference.

The retainer 40 also makes the antenna 10 a modular component that can be easily installed or removed from the pager unit. Also, the antenna assembly can now be tested as a discrete unit, permitting the discovery of antenna faults prior to assembly. In this way, the present antenna assembly improves reliability and reduces the cost of manufacture by reducing pager unit failures due to antenna faults.

The present antenna system 10 can also be designed to include a high current portion 32 to make the antenna insensitive to the presence of metal components in close proximity to the antenna, such as metal fasteners and the like. The high current portion 32 is effectively a built-in short circuit that precludes shorts due to the metal components. This effect is controlled by altering the effective electrical length of the antenna to create a phase shift of the antenna structure at the desired resonant frequency. This phase shift permits the placement of a voltage null, corresponding to a current peak, at a desired location, thus reducing sensitivity to metal components. This result can also be obtained and/or enhanced by adjusting the matching circuits and the meanders in the antenna lines 12, 22.

The design of the present invention provides an antenna that is first matched for the physical structure of the pager, i.e., batteries, LCD, and radio components. Secondly, the present antenna is matched for environmental factors such as metal components. Third, the antenna is matched for impedance with the radio. These factors result in an antenna that is insensitive to environmental factors. The present antenna system is easier to manufacture than previous systems, and requires less critical placement of the components. Also, since the bandwidth is derived from the coupling effect, the present invention eliminates the tuning circuits from the matching networks of previous antennas, thus avoiding the matching problems encountered with other wide bandwidth antennas. Further, the tolerances of components in the pager system used with the present invention are reduced, and construction is simplified.

As described hereinabove, the present invention solves many problems associated with previous systems and presents many improvements in efficiency and operability. However, it will be appreciated that various changes in the details, materials and arrangements of parts which have been herein described and illustrated in order to explain the nature of the invention may be made by those skilled in the art within the principle and scope of the invention as expressed by the appended claims.

We claim:

1. A dual antenna system for an RF data communications device, comprising:

two physically-separated, but electroctromagnetically-coupled meandering antenna lines, wherein one of the meandering antenna lines forms a receive antenna and the other meandering antenna line forms a transmit antenna, each of the receive and transmit antennas having an aggregate structure formed so as to substantially extend in two dimensions, thereby forming a top-loaded monopole antenna, wherein each meandering antenna line includes at least one localized bend, the localized bends of the two antennas being in close physical proximity to each other in order to electromagnetically couple the transmit antenna to the receive antenna.

2. The dual antenna system of claim 1, wherein the meandering antenna lines are formed onto a flexible substrate and affixed to a rigid dielectric retainer.

3. The dual antenna system of claim 1, wherein each respective antenna line is tuned for a separate bandwidth.

4. The dual antenna system of claim 1, wherein at least one of the antenna lines further comprises at least one high current portion for reducing interference from close proximity metal components.

5. A dual antenna system for an RF data communications device, comprising:

a receive antenna comprising a first meandering line having an aggregated structure formed so as to substantially extend in two dimensions, wherein the first meandering antenna line includes at least one localized bend; and a transmit antenna comprising a second meandering antenna line that is physically separate, but electromagnetically-coupled to the first meandering antenna line, the second meandering antenna line having an aggregate structure formed so as to substantially extend in two dimensions, wherein the second meandering antenna line also includes at least one localized bend in physical proximity to the localized bend of the first meandering antenna line so as electromagnetically couple the two meandering line antennas.

6. The dual antenna system of claim 5 wherein each respective antenna line is tuned for a separate bandwidth.

7. The dual antenna system of claim 5 wherein the meandering antenna lines are formed onto a flexible substrate and affixed to a rigid dielectric retainer.

8. The dual antenna system of claim 5 wherein at least one of said antenna lines further comprise at least one high current portion for reducing interference from close proximity metal components.

9. An antenna, comprising:

a transmit antenna line having a localized bend, wherein the localized bend includes a length of antenna line that is nonlinear; and a receive antenna line including a localized bend, wherein the localized bend includes a length of antenna line that is nonlinear;

wherein the transmit antenna line and the receive antenna line are physically separate from each other, but are electromagnetically-coupled by positioning the localized bends of the transmit and receive antenna lines in close physical proximity with each other.

* * * * *